US011098438B2

(12) United States Patent
Park et al.

(10) Patent No.: US 11,098,438 B2
(45) Date of Patent: Aug. 24, 2021

(54) METHOD FOR CONTROLLING DRYER

(71) Applicant: LG Electronics Inc., Seoul (KR)

(72) Inventors: Minsung Park, Seoul (KR); Junseok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 201 days.

(21) Appl. No.: 16/098,757

(22) PCT Filed: Apr. 28, 2017

(86) PCT No.: PCT/KR2017/004611
§ 371 (c)(1),
(2) Date: Nov. 16, 2018

(87) PCT Pub. No.: WO2017/191956
PCT Pub. Date: Nov. 9, 2017

(65) Prior Publication Data

US 2019/0136444 A1 May 9, 2019

(30) Foreign Application Priority Data

May 4, 2016 (KR) ..... 10-2016-0055295

(51) Int. Cl.
*D06F 58/30* (2020.01)
*D06F 58/04* (2006.01)
(Continued)

(52) U.S. Cl.
CPC ..... *D06F 58/30* (2020.02); *D06F 58/04* (2013.01); *F26B 21/00* (2013.01); *F26B 21/12* (2013.01); *F26B 25/06* (2013.01)

(58) Field of Classification Search
CPC ..... D06F 58/30; D06F 58/04; D06F 58/32; D06F 58/34; D06F 58/46; D06F 2103/24;
(Continued)

(56) References Cited

U.S. PATENT DOCUMENTS

2009/0282695 A1* 11/2009 Kreutzfeldt ..... D06F 58/30 34/443
2009/0320318 A1* 12/2009 Kim ..... D06F 39/008 34/428
(Continued)

FOREIGN PATENT DOCUMENTS

CN 1724803 1/2006
CN 1727561 2/2006
(Continued)

OTHER PUBLICATIONS

Translation of International Search Report in International Application No. PCT/KR2017/004611, dated Aug. 24, 2017, 2 pages.
(Continued)

*Primary Examiner* — Edelmira Bosques
*Assistant Examiner* — Bao D Nguyen
(74) *Attorney, Agent, or Firm* — Fish & Richardson P.C.

(57) ABSTRACT

A method for controlling a dryer according to an embodiment of the present invention includes: an operation of, when a dusting mode is selected and a start command is input, rotating a drying drum at a first rotational speed V1 in a first direction for a first set time; an operation of, after the first set time elapses, rotating the drying drum at a second rotational speed V2 in a second direction opposite to the first direction for a first set time; and an operation of rotating a drying fan along with the drying drum, when the drying drum rotates in the second direction, dust staining on an object introduced into the drying drum is separated from the object, and when the drying drum rotates in the first direction, the separated dust is discharged to the outside of the drying drum by a forced air flow generated by the drying fan.

18 Claims, 4 Drawing Sheets

(51) Int. Cl.
*F26B 21/12* (2006.01)
*F26B 25/06* (2006.01)
*F26B 21/00* (2006.01)

(58) Field of Classification Search
CPC ..... D06F 2103/38; D06F 58/203; D06F 2101/00; D06F 2101/20; D06F 39/008; F26B 21/00; F26B 21/06; F26B 21/12; F26B 25/22; F26B 25/06
USPC ..... 34/487
See application file for complete search history.

(56) References Cited

U.S. PATENT DOCUMENTS

2010/0050465 A1* 3/2010 Im ..... D06F 39/008 34/380
2012/0005918 A1* 1/2012 Kim ..... D06F 58/30 34/491
2012/0186305 A1* 7/2012 Taniguchi ..... D06F 58/02 68/19
2014/0059881 A1* 3/2014 Kim ..... D06F 39/02 34/493
2015/0089832 A1* 4/2015 Kang ..... D06F 29/005 34/499

FOREIGN PATENT DOCUMENTS

| | | |
|---|---|---|
| CN | 1888293 | 1/2007 |
| CN | 103820981 | 5/2014 |
| EP | 2458061 | 5/2012 |
| EP | 2857576 | 4/2015 |
| JP | H09-038390 | 2/1997 |
| KR | 1020110033910 | 4/2011 |
| KR | 10-2011-0082246 | 7/2011 |
| KR | 10-2007-0040900 | 6/2012 |
| KR | 10-2015-0039630 | 4/2015 |
| KR | 10-2015-0081602 | 7/2015 |

OTHER PUBLICATIONS

Extended European Search Report in European Application No. 17792858.7, dated Dec. 4, 2019, 8 pages.
Chinese Office Action in Chinese Appln. No. 201780027944, dated Apr. 30, 2020, 17 pages (with English translation).

* cited by examiner

METHOD FOR CONTROLLING DRYER

TECHNICAL FIELD

The present invention relates to a method for controlling a dryer.

BACKGROUND ART

A dryer for drying the laundry is a type of clothes processing apparatus where high-temperature hot air is supplied to the inside of a drying drum while the drying drum with the laundry introduced thereinto is rotating in one direction or a two-way direction, and thus, the wet laundry is dried.

Generally, one method of a gas combustion method, an electric heater method, and a heat pump cycle method may be applied for generating high-temperature hot air supplied to the inside of the drying drum.

Moreover, recently, dryers or washing machines including a function of dusting off foreign materials including dust or mites staining on clothes or bedclothes are being released, and detailed content is disclosed in the following prior art reference.

However, the proposed prior art reference has the following problems.

In a case where a drum rotates clockwise or counterclockwise, the drum rotates in a state where bedclothes and the laundry is adhered to an inner circumference surface of the drum, and due to this, an effect or a function for dusting off bedclothes cannot be substantially obtained.

In other words, it is described in the specification of the prior art reference that, in a state where bedclothes spread and are adhered to the inner circumference surface of the drum, harmful materials such as mites adhered to the bedclothes may be separated from the bedclothes due to hot air supplied to the inside of the drum. However, in a state where foreign materials are adhered to the inner circumference surface of the drum, the foreign materials are not well separated from the bedclothes without an operation of dusting off the bedclothes with hand substantially.

Prior art reference: Korean Patent Publication No. 2015-0039630 (2015 Apr. 13)

DISCLOSURE

Technical Problem

The present invention is proposed for solving the above-described problems.

Technical Solution

A method for controlling a dryer according to an embodiment of the present invention for achieving the object includes: an operation of, when a dusting mode is selected and a start command is input, rotating a drying drum at a first rotational speed V1 in a first direction for a first set time; an operation of, after the first set time elapses, rotating the drying drum at a second rotational speed V2 in a second direction opposite to the first direction for a first set time; and an operation of rotating a drying fan along with the drying drum, when the drying drum rotates in the second direction, dust staining on an object introduced into the drying drum is separated from the object, and when the drying drum rotates in the first direction, the separated dust is discharged to the outside of the drying drum by a forced air flow generated by the drying fan.

Advantageous Effect

A method for controlling a dryer according to an embodiment of the present invention having the above-described configuration obtains the following effects.

First, when a dusting mode starts, a drying drum alternately performs a clockwise rotation and a counterclockwise rotation, and in this case, the drying drum rotates at a rotational speed which allows bedclothes accommodated into the drying drum to rotate with being adhered to the drying drum and then fall at a highest point, thereby obtaining an effect of dusting off the bedclothes. As described above, since bedclothes fall whenever the drying drum rotates once, an effect where the bedclothes are sufficiently dusted off for a set time may be obtained, and thus, foreign materials including mites and dust adhered to the bedclothes may be separated from the bedclothes.

Second, in a case where only a bedclothes dusting function is needed without needing drying, only dusting is performed without supplying hot air at an initial stage of dusting off bedclothes, and the hot air is supplied at a latter stage of dusting off the bedclothes, thereby minimizing power consumption needed for supplying the hot air. Furthermore, when bedclothes for which dusting is completed is taken out from the drying drum, there is an effect where a consumer can have a warm and soft feeling.

MODE FOR INVENTION

Hereinafter, a method for controlling a dryer according to an embodiment of the present invention will be described in detail with reference to the drawings.

Figure 1:
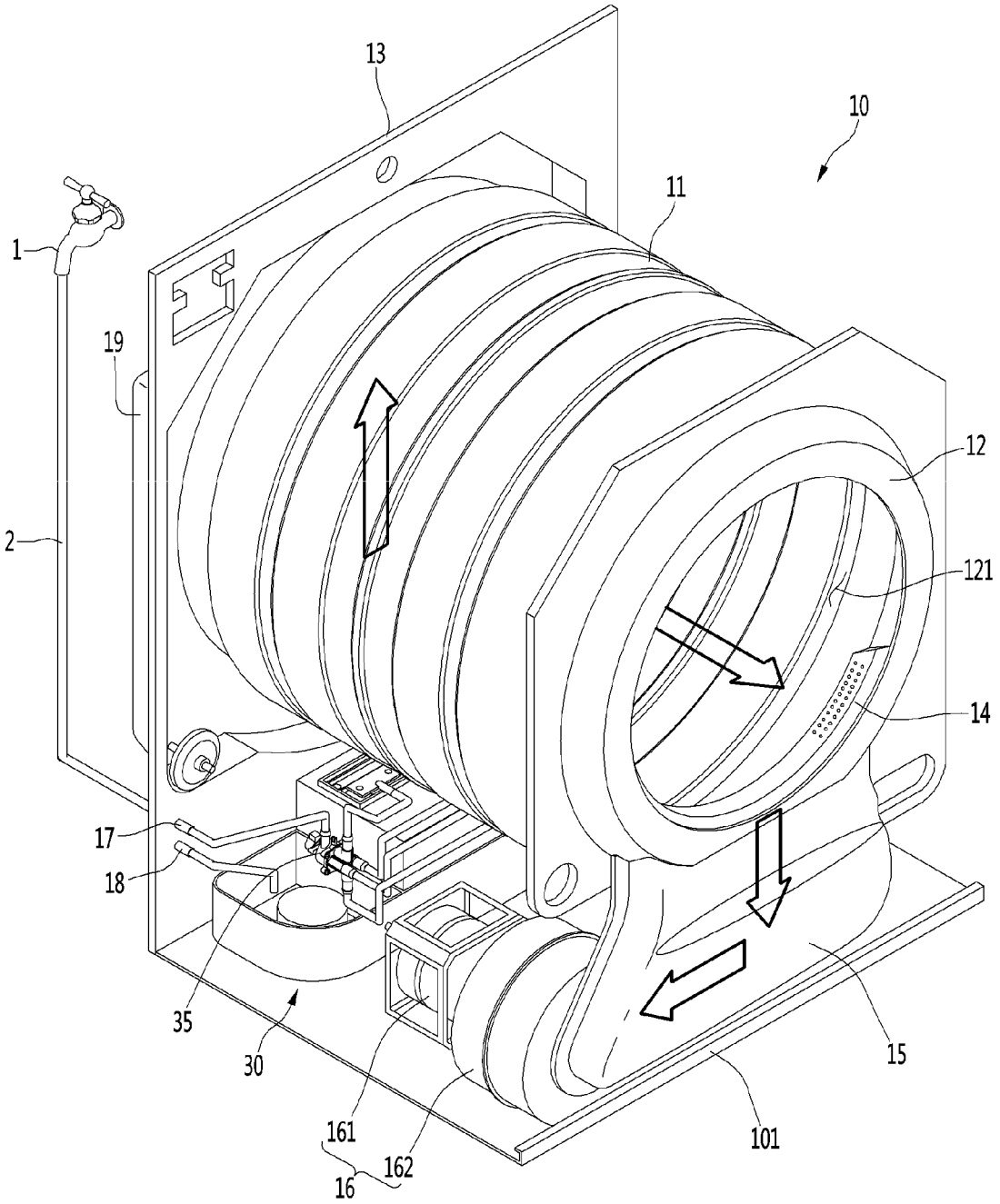
FIG. 1 is a perspective view of a dryer where a control method according to an embodiment of the present invention is implemented.
Figure 2:
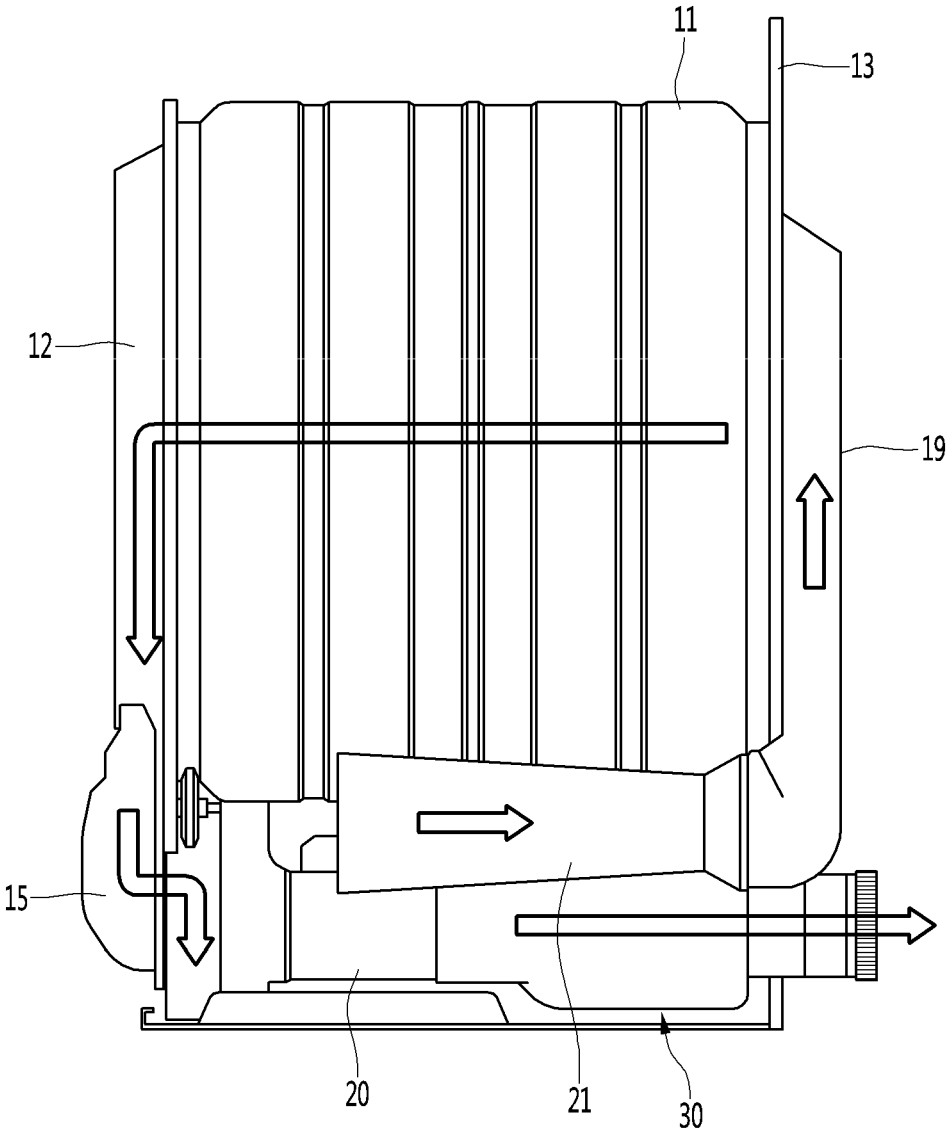
FIG. 2 is a side view of the dryer.

FIG. 1 is a perspective view of a dryer where a control method according to an embodiment of the present invention is implemented, and FIG. 2 is a side view of the dryer.

Hereinafter, as an example of a dryer to which the control method according to an embodiment of the present invention is applied, a heat pump type clothes dryer will be described. However, the control method according to an embodiment of the present invention may be applied to a dryer which generates hot air by using gas combustion or an electric heater, in addition to the heat pump type clothes dryer.

Referring to FIGS. 1 and 2, a dryer 10 to which the control method according to an embodiment of the present invention is applied may include a drying drum 11 into which a drying object is introduced, a dryness sensor (not shown) which is mounted on an inner circumference surface of the drying drum 11, a front cabinet 12 which supports a front portion of the drying drum 11, a blocking member 14 which is mounted on a floor portion of the front cabinet 12, a rear cabinet 13 which supports a rear portion of the drying drum 11, and a lint filter cleaning device 30 which is provided under the drying drum 11.

In detail, the dryness sensor may include an electrode sensor which senses a degree of dryness of the laundry by using a potential value generated by a contact with the laundry rotating inside the drying drum 11. Also, the dryness sensor may be mounted on one side of an inner circumference surface of the drying drum 11 contactable with the laundry. That is, the dryness sensor may be disposed at any one of a front end portion, the rear portion, and an inner circumference surface of a body part, connecting the front end portion to the rear portion, of the drum.

Moreover, the clothes dryer 10 may further include a suction duct 21 which sucks air which is to be supplied to the drying drum 11, a rear duct 19 which connects the suction duct 21 to an air inflow hole provided in a rear surface of the drying drum 11, a guide duct 15 which is connected to a lower surface of the front cabinet 12 and guides air discharged from the drying drum 11, a blowing device 16 which is connected to an outlet end of the guide duct 15, and an exhaust duct 20 which is connected to an outlet end of the blowing device 16. The lint filter cleaning device 30 is mounted at an arbitrary position of the exhaust duct 20 and allows lint, included in air flowing along the exhaust duct 20, to be filtered out while the air passes through a lint filter assembly establishing the lint filter cleaning device 30.

A middle cabinet (not shown) is provided between the front cabinet 12 and the rear cabinet 13 and covers and protects the drying drum 11 and various components disposed under the drying drum 11. The middle cabinet may define both side surfaces and an upper surface of the clothes dryer 10, a base plate 101 which defines a floor portion of the clothes dryer 10 may be provided on a lower surface of the middle cabinet, and the components may be mounted on the base plate 101.

Moreover, the blocking member 14 is provided for preventing foreign materials (for example, foreign materials which are large in volume and is rigid like coins and ballpoint pens) included in a drying object from being sucked into the guide duct 15. Even when foreign materials such as lint are sucked into the guide duct 15, the foreign materials are filtered out by the lint filter assembly (described below) equipped in the drying drum 11, and other foreign materials (i.e., foreign materials which has volume and is hard) are blocked by the blocking member 14 and remain in the drying drum 11. For example, when foreign materials other than lint are sucked into the guide duct 15, the blowing device 16 may be damaged, or a clittering sound may occur inside the exhaust duct 15, and due to this, it is required that the blocking member 14 prevents the foreign materials from deviating from the drying drum 11. Also, the blocking member 14 may be detachably coupled to the front cabinet 12.

Moreover, a cleaning water supply pipe 17 and a cleaning water drainage pipe 18 are connected to the lint filter cleaning device 30. An inlet end of the cleaning water supply pipe 17 may be mounted on the rear cabinet 13 and may be connected to a water supply pipe 2 connected to an external water supply source 1. Also, an outlet end of the cleaning water supply pipe 17 is connected to an inflow port of a control valve 35 of the lint filter cleaning device 30. Also, an inlet end of the cleaning water drainage pipe 18 is connected to a drainage pump assembly (not shown) of the lint filter cleaning device 30.

Moreover, the blowing device 16 includes a driving motor 161 which rotates the drying drum 11 and a drying fan 162 which is connected to a rotational shaft of the driving motor 161. The drying fan 162 is disposed in an outlet end side of the guide duct 15 and guides air, which passes through drying drum 11 and is guided to the guide duct 15, to the exhaust duct 20. The drying drum 11 rotates by means of a pulley (not shown) connected to the rotational shaft of the driving motor 161 and a belt surrounded around an outer circumference surface of each of the pulley and the drying drum. That is, when the driving motor rotates, the pulley rotates, and when the pulley rotates, the belt rotates the drying drum 11. Based on such a structure, when the driving motor 161 operates, the drying drum 11 and the drying fan 162 rotate in the same direction.

In an exhaust type dryer, a gas combustion device is provided in an inlet portion of the suction duct 21, and heats air sucked into the suction duct 21 at a high temperature. Also, in an electric dryer, an electric heater is mounted inside the rear duct 19 and heats, at a high temperature, air flowing to the suction duct 21 before the air flows into the drying drum 11.

Moreover, in a heat pump type dryer, a heat pump cycle (a cycle including a compressor, a condenser, an expansion member, and an evaporator) is installed in a cabinet. In detail, when the compressor is driven, refrigerant is compressed in a high-temperature and high-pressure vapor refrigerant state and is transferred to the condenser. Also, the condenser phase-changes high-temperature and high-pressure vapor refrigerant to high-temperature and high-pressure liquid refrigerant. At this time, heat emitted from the condenser passes through the suction duct 21 and flows into the drying drum 11 by using the drying fan 162.

To briefly describe a drying process of the clothes dryer 10 having the above-described configuration, a drying object is introduced into the drying drum 11 through an introduction hole 121 included in the front cabinet 12. Also, when a drying start command is input, the blowing device 16 operates, and the drying drum 11 rotates in one direction. Also, air flowing into the suction duct 21 is heated at a high temperature by one of the condenser, the gas combustion device, and the electric heater of the heat pump cycle. Also, air heated at a high temperature flows into the drying drum 11 through a rear surface of the drying drum 11 along the rear duct 19. Also, high-temperature dry air flowing into the drying drum 11 dries the drying object and is changed to a high-temperature humid state. Also, high-temperature humid air passes through the blocking member 14 together with the lint separated from the drying object and is guided to the guide duct 15. Also, the high-temperature humid air guided to the guide duct 15 is guided to the exhaust duct 20 by the blowing device 16. Also, the high-temperature humid air guided to the exhaust duct 20 passes through the lint filter cleaning device 30, and the lint in the humid air is filtered out by the lint filter assembly. Also, the lint filter cleaning device 30 operates, and thus, the lint adhered to the lint filter assembly is separated therefrom and is discharged to the outside by the drainage pump assembly along with cleaning water.

Figure 3:
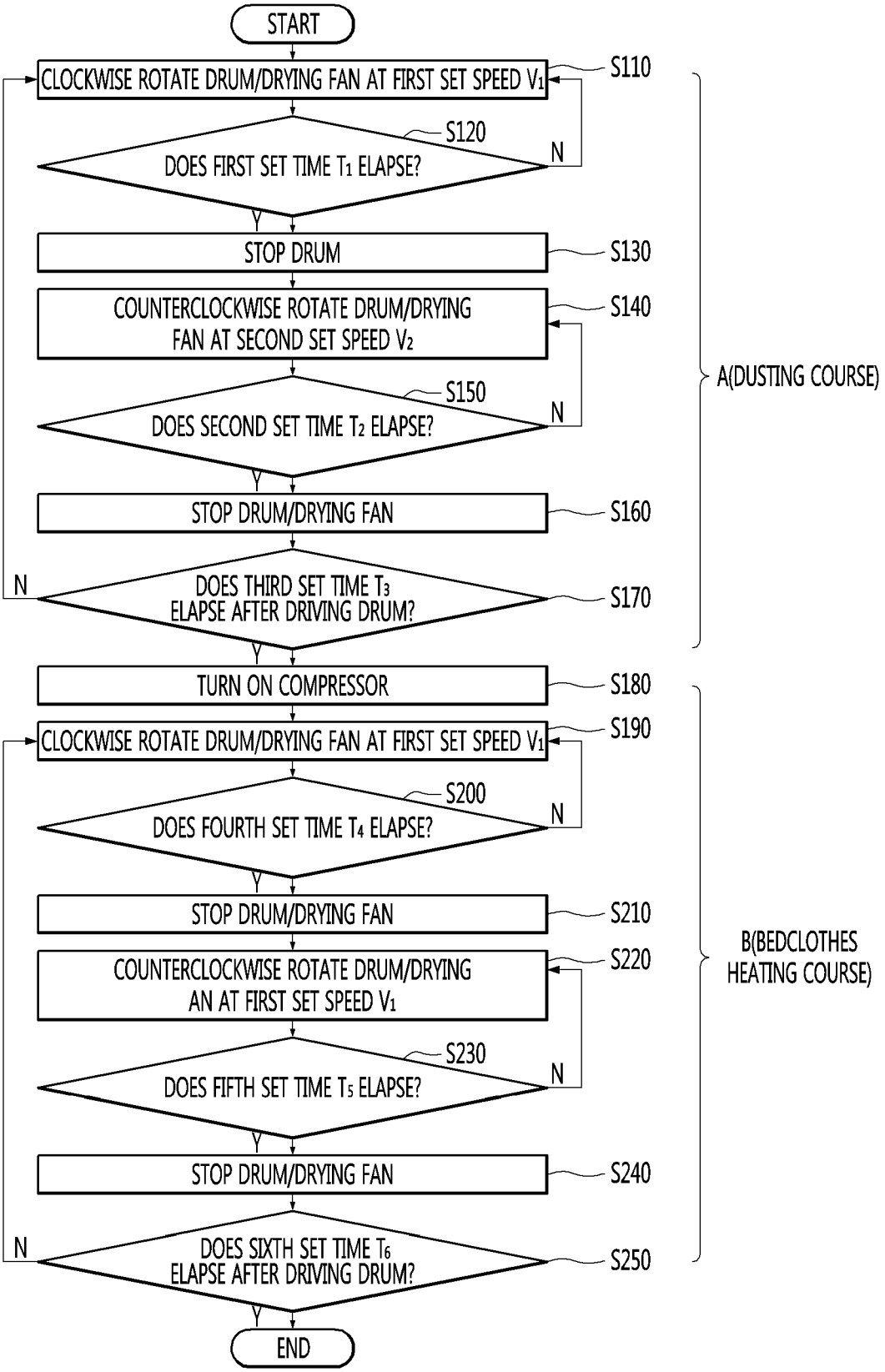
FIG. 3 is a flowchart illustrating a method for controlling a dryer according to an embodiment of the present invention.
Figure 4:
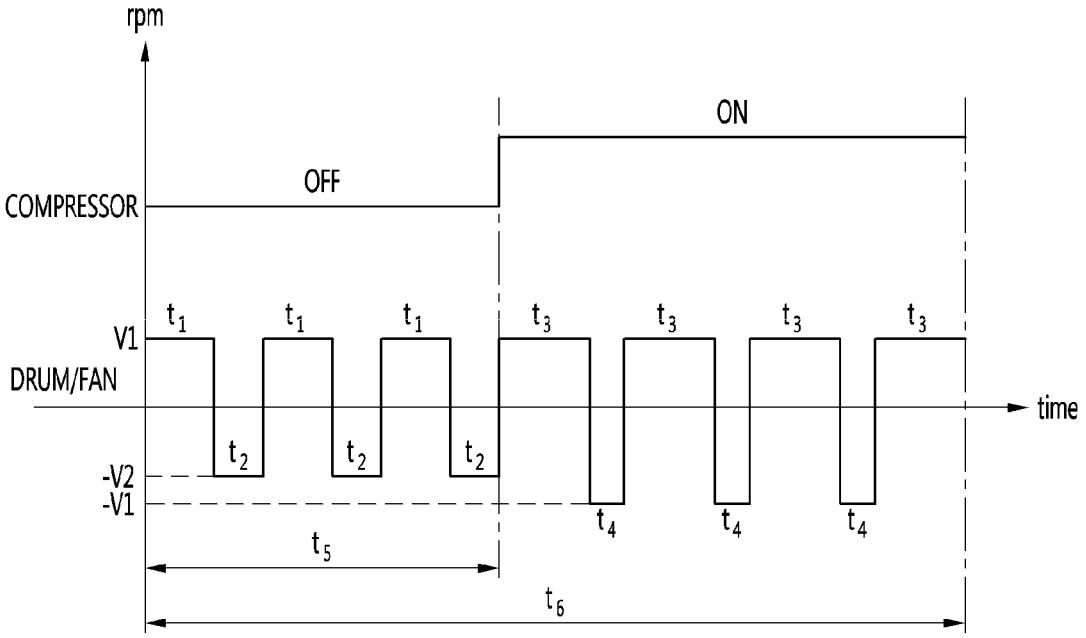
FIG. 4 is a graph showing operating states of a compressor, a drying drum, and a drying fan based on a method for controlling a dryer according to an embodiment of the present invention.

FIG. 3 is a flowchart illustrating a method for controlling a dryer according to an embodiment of the present invention, and FIG. 4 is a graph showing operating states of a compressor, a drying drum, and a drying fan based on a method for controlling a dryer according to an embodiment of the present invention.

Hereinafter, a control method according to an embodiment of the present invention will be described by using, for example, a dryer where a drying fan is connected to a rotational shaft of a driving motor driving a drying drum.

Referring to FIGS. 3 and 4, in the control method according to an embodiment of the present invention, when a dusting mode is selected and an operation command is input, the drying drum 11 and the drying fan 162 rotate clockwise at a first set speed V1 (S110). The first set speed V1 may be a speed at which a drying object including bedclothes introduced into the drying drum rotates with being adhered to an inner circumference surface of the drying drum. For example, the first set speed may be 2850 rpm.

Moreover, while the drying drum 11 is rotating at the first set speed V1, some of foreign materials including dust, lint, and mites staining on the drying object may be separated from the drying object by a forced air flow caused by a rotation of the drying fan 162. Also, the separated foreign materials are discharged to the outside of the drying drum.

Moreover, while the drying drum 11 and the drying fan 162 are rotating clockwise, whether the first set time t1 elapses (S120). The first set time may be four minutes and 30 seconds, for example. Also, when the first set time t1 elapses, the drying drum 11 stops (S130).

Moreover, the drying drum 11 and the drying fan 162 are controlled to counterclockwise rotate at a second set speed V2 (S140), and when a second set time t2 elapses (S150), a rotation of the drying drum 11 stops (S160).

The second set speed V2 may be a rotational speed where, while the drying drum 11 is rotating, the drying object increases along with drying drum 11 with being adhered to the drying drum 11 and then falls to a floor of the drying drum 11 around a highest point. Also, the second set speed V2 may be set to a speed which is slower than a rotation speed of the drying drum 11 applied to a drying course or a normal drying process of drying the wet laundry.

The second set speed V2 may be less than the first set speed V1, and for example, may be 2,000 rpm.

Moreover, the second set time t2 may be 30 seconds, for example. The second set time t2 may be set to an arbitrary time which is shorter than the first set time t1.

In detail, while the drying drum 11 and the drying fan 162 rotate counterclockwise, a dusting function is performed inside the drying drum 11. That is, foreign materials are separated from the drying object in a process where the drying object falls. Also, an air flow is hardly performed inside the drying drum 11, and thus, the foreign materials separated from the drying object float inside the drying drum 11.

Moreover, whenever the drying drum 11 rotates once, the drying object is raised and then is lowered, and thus, even when the drying drum 11 rotates counterclockwise for a time which is shorter than a clockwise time, an effect of dusting off the drying object may be sufficiently obtained.

Moreover, foreign materials floating inside the drying drum 11 are discharged to the outside of the drying drum 11 when the drying drum 11 and the drying fan 162 rotate clockwise again.

The above-described clockwise and counterclockwise operations of the drying drum 11 and the drying fan 162 are performed in a state where hot air is not supplied to the inside of the drying drum, and such a process may be referred to as "a dusting course A".

Moreover, whether a third set time t3 elapses after driving the drum is determined, and when the third set time t3 elapses, the dusting course ends. That is, the dusting course is performed for only the third set time t3, and the third set time t3 may be 15 minutes, for example.

If the dusting course ends, the compressor is turned on (S180). In the heat pump type dryer, when the compressor is turned on, the heat pump cycle operates, high-temperature air occurring in the condenser is put in a state capable of being supplied into the drying drum.

In detail, when the condenser is turned on, the drying drum 11 and the drying fan 162 rotate clockwise at the first set speed V1 (S190), and when a fourth set time t4 elapses (S200), the rotation of the drying drum 11 and the drying fan 162 stops (S210). When the drying drum 11 rotates clockwise, the drying object rotates along with the drying drum 11 with being adhered to an inner surface of the drying drum 11. Also, when the drying fan 162 rotates clockwise, hot air is supplied to the inside of the drying drum 11, and some foreign materials staining on the drying object and foreign materials floating inside the drying drum 11 are discharged to the outside of the drying drum 11 by the hot air.

Moreover, the bedclothes are warmed by the hot air. A surface temperature of the bedclothes warmed by the hot air is about 42 degrees C. and may be a temperature which enables a user to have a warm and soft feeling when touching the bedclothes with hand.

Here, the fourth set time t4 may be 7 minutes, for example.

Moreover, when the fourth set time t4 elapses, the drying drum 11 and the drying fan 162 rotate counterclockwise at the first set speed V1 (S220). Also, whether a fifth set time t5 elapses after a counterclockwise rotation starts is determined (S230), and when the fifth set time t5 elapses, the rotation of the drying drum 11 and the drying fan 162 stops S(240).

Here, the fifth set time t5 may be 10 seconds, but is not limited thereto.

Moreover, the reason that a clockwise rotational speed and a counterclockwise rotational speed of the drying drum 11 are identically set after driving the compressor is for solving a phenomenon where the laundry is twisted in a clockwise/counterclockwise rotation process of the drying drum 11, and the drying drum 11 rotate counterclockwise at the same speed as the clockwise rotational speed.

As described above, a process of clockwise and counterclockwise rotating the drying drum 11 and the drying fan 162 with hot air being supplied may be referred to as "a bedclothes heating course B". In detail, the bedclothes heating course may be performed until a sixth set time elapses after driving the drum (S250).

The sixth set time may denote a total time taken in performing the dusting mode. Therefore, the "bedclothes heating course B" may be performed for a time, except a time taken in the dusting course A, of the total time of the dusting mode.

Moreover, the sixth set time may be 50 minutes, for example. Also, the sixth set time is counted from a time when the "dusting course A" starts. Therefore, when the "dusting course A" is performed for 15 minutes, the "bedclothes heating course B" may be performed for 35 minutes.

Moreover, when the sixth set time t6 elapses, a whole process of the dusting mode ends completely. Accordingly, the rotation of the drying drum 11 and the drying fan 162 stops, and moreover, driving of the compressor stops.

In another embodiment, in the "bedclothes heating course B", a counterclockwise rotational speed of the drying drum 11 may be set to the second set speed V2, and a dusting function may be performed.

In other words, the dusting course may be performed from a dusting mode start time to a dusting mode end time, and the bedclothes heating course may start from after a certain time elapses from the dusting mode start time and may be performed until the dusting mode end time.

In another embodiment, in the "dusting course A", a clockwise rotational speed of the drying drum 11 may be set to the second rotational speed V2, and even when the drying drum 11 rotates clockwise, the dusting function may be performed.

At this time, in a case where a forced convection caused by the drying fan 162 does not effectively occur when the drying drum 11 rotates clockwise at the second rotational speed V2, the drying drum 11 and the drying fan 162 may be independently rotated by separate driving motors (i.e., a drum driving motor and a fan motor).

That is, without varying a clockwise rotational speed of the drying fan 162, only a clockwise rotational speed of the drying drum 11 may be set to the second rotational speed V2 which is slower than the first rotational speed V1.

In another embodiment, in the embodiment proposed in FIG. 3, the compressor is driven simultaneously with the start of the "dusting course A", and thus, the supply of hot air is performed together, whereby a method of simultaneously performing a dusting function and a bedclothes heating function may be proposed.

To provide a detailed description, in the flowchart of FIG. 3, a process where the compressor is turned on simultaneously with or prior to that the drying drum 11 and the drying fan 162 rotate clockwise at the first set speed V1 is added. Also, the "bedclothes heating course B" performed in steps S180 to S250 may be omitted.

Moreover, while the compressor is driven and hot air is being supplied, a process from step S110 to step S160 may be performed for the third set time t3 and then all processes may end, or may be performed for the sixth set time t6 and then all processes may end.

An example where the compressor is driven to drive the heat pump cycle so as to supply hot air to the inside of the drying drum has been described above, but without being limited thereto, the spirit of the present invention may be applied to another type of dryer to which a hot air supplying method using gas combustion or an electric heater is applied.

In other words, step (S180) of turning on the compressor may be construed as including a step of supplying hot air to the inside of the drying drum by operating a hot air generating means (gas combustion or an electric heater).

The invention claimed is:

1. A method for controlling a dryer, the method comprising:

based on selection of a dusting mode and input of a start command, rotating a drying drum at a first rotational speed in a first direction for a first set time;

after rotating the drying drum in the first direction for the first set time, rotating the drying drum at a second rotational speed in a second direction opposite to the first direction for a second set time such that dust on an object in the drying drum is separated from the object, the second rotational speed being different from the first rotational speed, and the second set time being shorter than the first set time; and rotating a drying fan while rotating the drying drum in the first direction or the second direction, wherein rotating the drying drum in the first direction comprises:

after rotating the drying drum in the second direction for the second set time, rotating the drying drum again in the first direction while rotating the drying fan such that the separated dust is discharged to an outside of the drying drum by air flow generated by the drying fan, based on rotating the drying drum in the second direction for the second set time, determining whether a third set time has elapsed from the input of the start command, and based on determining that the third set time has not elapsed from the input of the start command, rotating the drying drum again in the first direction such that the drying drum is alternately rotated.

2. The method of claim 1, wherein:

the first rotational speed is a rotational speed of the drying drum at which the object is in contact with an inner circumference surface of the drying drum, and the second rotational speed is a rotational speed of the drying drum at which the object is raised by rotation of the drying drum and then falls to a lower portion of the drying drum.

3. The method of claim 1, wherein rotating the drying drum and the drying fan comprises rotating a single driving motor to rotate the drying drum and the drying fan at the same speed and in the same direction.

4. The method of claim 1, wherein rotating the drying drum and the drying fan comprises independently rotating separate driving motors to rotate the drying fan and the drying drum in the same direction or in opposite directions.

5. The method of claim 4, wherein rotating the drying fan comprises:

while rotating the drying drum in the second direction, rotating the drying fan such that the air flow is generated inside the drying drum regardless of a rotational direction of the drying drum.

6. The method of claim 1, further comprising driving a compressor to supply hot air to an inside of the drying drum.

7. The method of claim 6, wherein the dusting mode comprises a first course and a second course, the second course comprising driving the compressor based on determining that the third set time has elapsed from the input of the start command, and wherein the method further comprises terminating the first course of the dusting mode based on determining that the third set time has elapsed from the input of the start command.

8. The method of claim 7, further comprising:

performing the second course after termination of the first course;

determining whether a sixth set time has elapsed from the input of the start command; and based on determining that the sixth set time has elapsed from the input of the start command, terminating the second course of the dusting mode.

9. The method of claim 8, further comprising:

after the third set time elapsed from the input of the start command, rotating the drying drum in the first direction and the second direction until reaching the sixth set time from the input of the start command.

10. The method of claim 6, wherein driving the compressor comprises driving the compressor based on determining that the third set time has elapsed from the input of the start command.

11. The method of claim 10, further comprising:

before determining that the third set time has elapsed from the input of the start command, stopping the drying drum;

based on determining that the third set time has elapsed from the input of the start command, driving the compressor and rotating the drying drum in the first direction for a fourth set time; and based on determining that the drying drum has rotated in the first direction for the fourth set time, rotating the drying drum in the second direction for a fifth set time.

12. The method of claim 11, wherein rotating the drying drum in the first direction for the fourth set time comprises rotating the drying drum at the first rotational speed, and wherein rotating the drying drum in the second direction for the fifth set time comprises rotating the drying drum at the first rotational speed.

13. The method of claim 12, wherein the fourth set time is longer than the first set time and the fifth set time, and the first set time is longer than the second set time.

14. The method of claim 12, further comprising:

based on determining that the drying drum has rotated for the fifth set time, stopping rotation of the drying drum and the drying fan.

15. The method of claim 11, further comprising:

based on determining that the drying drum has rotated for the fourth set time, stopping rotation of the drying drum and the drying fan.

16. The method of claim 1, further comprising:

after rotating the drying drum in the first direction, determining whether the drying drum has rotated for the first set time; and based on determining that the drying drum has rotated for the first set time, stopping rotation of the drying drum.

17. The method of claim 1, wherein rotating the drying fan comprises rotating the drying fan while rotating the drying drum in the first direction and the second direction.

18. A method for controlling a dryer, the method comprising:

based on selection of a dusting mode and input of a start command, rotating a drying drum at a first rotational speed in a first direction for a first set time;

after rotating the drying drum in the first direction for the first set time, rotating the drying drum at a second rotational speed in a second direction opposite to the first direction for a second set time such that dust on an object in the drying drum is separated from the object;

rotating a drying fan while rotating the drying drum in the first direction or the second direction;

after rotating the drying drum in the second direction, determining whether the drying drum has rotated for the second set time; and based on determining that the drying drum has rotated for the second set time, stopping rotation of the drying drum and the drying fan, wherein rotating the drying drum in the first direction comprises:

after rotating the drying drum in the second direction for the second set time, rotating the drying drum again in the first direction while rotating the drying fan such that the separated dust is discharged to an outside of the drying drum by air flow generated by the drying fan.

* * * * *